United States Patent [19]

Murray

[11] 4,366,015

[45] Dec. 28, 1982

[54] RUBBER DRIVING BAND, ARTILLERY SHELL EMPLOYING SAME, AND METHOD OF MAKING THE BAND AND ASSEMBLING SAME IN THE SHELL

[76] Inventor: Myles N. Murray, 15 Skyline Dr., Chagrin Falls, Ohio 44022

[21] Appl. No.: 150,336

[22] Filed: May 16, 1980

[51] Int. Cl.[3] ..... F42B 31/00

[52] U.S. Cl. ..... 156/185; 102/527; 156/86; 156/187; 156/194

[58] Field of Search ..... 156/86, 193, 194, 187, 156/184–185; 102/524–527

[56] References Cited

U.S. PATENT DOCUMENTS 2,400,533 5/1946 Buffington ..... 156/194 X 3,159,402 12/1964 Nichols ..... 156/86 X 3,697,348 10/1972 Farnam ..... 156/193 X 3,760,736 9/1973 Eig ..... 102/527

*Primary Examiner*—David A. Simmons

*Attorney, Agent, or Firm*—Maky, Renner, Otto & Boisselle

[57] ABSTRACT

An integrally molded laminated driving band for artillery shells is formed of radially alternating, circumferentially extending layers of fabric and rubber. The driving band is made by coating a fabric strip with uncured rubber, wrapping the coated strip to form an annular preform, and molding and curing the preform to form an integrally molded band. Various means are provided for assembling the driving band in an artillery shell.

8 Claims, 6 Drawing Figures

RUBBER DRIVING BAND, ARTILLERY SHELL EMPLOYING SAME, AND METHOD OF MAKING THE BAND AND ASSEMBLING SAME IN THE SHELL

BACKGROUND OF THE INVENTION

This invention relates generally to an improved driving band for use in artillery shells, to an improved artillery shell employing such driving band, and methods of making the driving band and assembling same in the shell. In addition, the improved band according to the invention may have other applications, e.g., as a sealing ring in deep well drilling installations or wherever a rubber band of high integrity and low elasticity is required.

In conventional weapon systems, there is a continuing need to improve ballistic performance while reducing ammunition production and fabrication costs. It is known that increased fire power, i.e., the ability to take out a target effectively at a longer range or more effectively at a conventional range, can be obtained by employing spin-stabilized projectiles using driving bands which are either retained or discarded during firing.

Heretofore, plastic driving bands have been employed and have resulted in substantial reduction in barrel wear while providing excellent effectiveness against targets. The plastic driving bands commonly are bonded by suitable adhesives to the artillery shell casings with shallow undercuts being provided under the band in the shell casing.

To be acceptable for military applications, the driving bands must be capable of surviving the stress of firing under severe ballistic and environmental conditions. For example, the bands must be capable of satisfactory performance even after being conditioned at extremely low temperatures such as minus 40° F.

SUMMARY OF THE INVENTION

With the foregoing in mind, it is a principal object of this invention to improve ballistic performance while reducing ammunition production and fabrication costs by providing another and improved driving band for use in artillery shells and which is capable of withstanding severe ballistic and environmental conditions.

It is another principal object of this invention to provide a method of making such band and assembling same in an artillery shell casing to provide a new and better artillery shell.

It is a further object of this invention to provide a new molded rubber band of high integrity and low elasticity for use in harsh environments, e.g., a seal in deep well drilling installations where the band is subjected to high loads and severe environmental conditions.

To the achievement of the foregoing and other objects of the invention, a rubber band of high integrity and low elasticity is obtained by coating a fabric strip with uncured rubber, partially curing or drying the rubber coating to a tacky state, spiral-wrapping the coated strip to form a coiled annular preform, and then molding and fully curing the preform in a predetermined shape thereby to provide an integrally molded laminated band formed of radially alternating, circumferentially extending layers of fabric and rubber. A preferred rubber is Buna-n rubber having a Shore A durometer hardness of at least about 75 after full cure while the fabric preferably is of cloth or metal material which may be essentially circumferentially inextensible.

Such molded laminated band may be assembled by suitable means as a driving band in an artillery shell. A preferred means is to mold the coiled preform directly on the shell casing in a band seat provided therefor. Another preferred means is to affix a thermally expansive metal ring to the radially inner surface of the driving band. The band and ring assembly is secured to the shell casing by first heating the assembly to expand the ring to a diameter such that it can be slipped over the shell casing to its desired position and then cooled to shrink-fit the metal band on the shell casing. In this manner, the band and ring assembly may be manufactured at a remote location and then assembled on the shell casing without substantially disrupting assembly of the artillery shell along an assembly line therefor. Accordingly, the dwell time otherwise required in the assembly line for applying the driving band to the shell casing such as by molding or bonding the band to the casing may be eliminated or substantially reduced thereby reducing assembly costs and time.

DETAILED DESCRIPTION OF THE DRAWING

Figure 1:
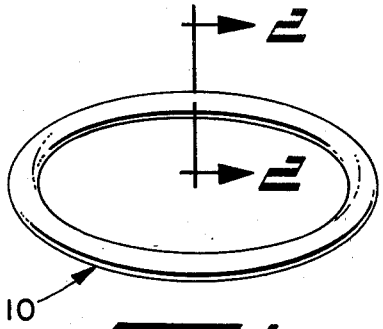
FIG. 1 is a perspective view of a band according to the invention.
Figure 2:
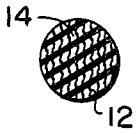
FIG. 2 is a section through the band of FIG. 1, taken along the line 2—2 thereof.

In FIGS. 1 and 2, an integrally molded laminated driving band according to the invention is designated generally by reference numeral 10. The driving band 10, also referred to as a rotating band, comprises a laminate consisting of radially alternating, circumferentially extending layers of fabric and rubber identified respectively by reference numerals 12 and 14. The fabric layers 12 preferably are of woven construction having minimal stretch circumferentially. Preferred fabric materials include cloth and metal fabrics. The rubber layers 14 preferably have a Shore A durometer hardness of at least about 75. A preferred rubber is Buna-n rubber; however, butyl rubber has been found to perform acceptably as a rotating band and is also preferred. It also is contemplated that other types of rubbers and particularly thermosetting rubbers may be used.

Figure 3:
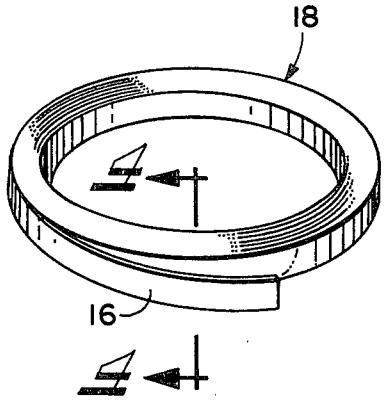
FIG. 3 is a perspective view of the annular preform according to the invention prior to molding thereof to form the band shown in FIG. 1, with the tail end of the coiled strip forming the preform pulled away from its adjacent turn for illustrative purposes.
Figure 4:
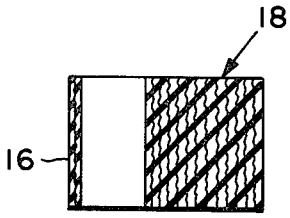
FIG. 4 is a section through the preform of FIG. 3, taken along the line 4—4 thereof.

Referring now to FIGS. 3 and 4, the band 10 is formed by first coating a fabric strip with uncured rubber preferably on both sides. This is best done by dipping the fabric strip into a bath of uncured rubber and then withdrawing the coated strip from the bath permitting the excess rubber to flow from the fabric strip. The rubber coated fabric strip identified by reference numeral 16 may then be dried or partially cured to its tacky state and then spiral wrapped to form a coiled annular preform 18. As seen in FIGS. 3 and 4, the tail end of the rubber coated fabric strip 16 is pulled away from the next adjacent turn of the strip to better illustrate the radially spaced, layered effect of the preform 18. It, however, will be appreciated that the tacky strip will adhere to itself when spiral wrapped to form the annular preform that may be easily handled without unraveling.

The coiled annular preform 18 may then be placed into a suitable mold (not shown) for molding, such as by compression molding, the preform to its desired final shape and for effecting final cure of the rubber by application of sufficient heat thereby to form the integrally molded laminated band 10. Because the rubber coats both sides of the fabric strip and also permeates through the strip, the outermost layer of the preform will be of rubber so that upon cure, the band will have the external appearance of rubber. Moreover, the integrally molded laminated band will be of high integrity and of minimum elasticity due to the alternate layers of fabric while having many of the advantages of rubber such as sealability and durability.

Figure 5:
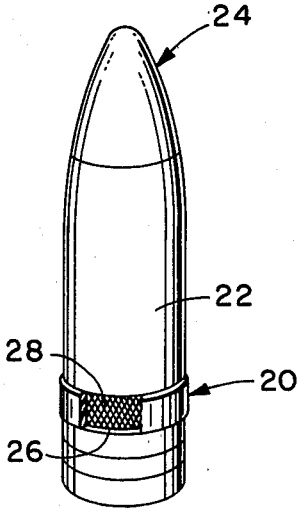
FIG. 5 is a perspective view, partly broken away and in section, of an artillery shell according to the invention employing as a driving band a band similar to that illustrated in FIG. 1 but of a slightly different cross-sectional shape.

Referring now to FIG. 5, a band 20 according to the invention is assembled on the shell casing 22 in an artillery shell designated generally by reference numeral 24. The band 20 is similar to band 10 but of an axially elongated configuration to resemble a more commonly employed type of driving band. Preferably the shell casing 22 has a band seat or groove 26 to receive the band which when retained in the band seat projects slightly radially outwardly beyond the outer surface of the casing. To assemble the band in the casing, the band being slightly radially elastic may be expanded to slip over the shell casing and then contracted by its own resiliency into the band seat. To prevent the band from rotating on the shell casing, the base surface 28 of the band seat may be knurled or a suitable adhesive may be employed.

The driving band 20 alternatively may be molded and cured directly on the shell casing 22. The coiled annular preform 18 is placed around the shell casing at the band seat 26 and a suitable mold employed to mold the preform into the band seat and to its predetermined shape and then to cure the preform to form the band 20. By molding the driving band directly on the shell casing, resistance to band separation during firing of the shell is believed to be greatly improved.

Figure 6:
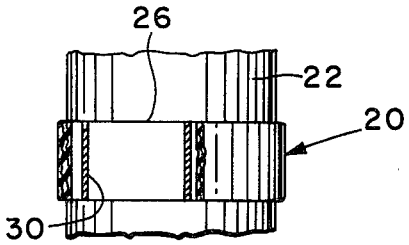
FIG. 6 is an enlarged front view, partly broken away and in section, of another artillery shell employing a band and ring assembly according to the invention.

In FIG. 6 there is shown still another means for assembling the driving band 20 on the artillery shell casing 22. The band 20 at its radially inner surface may have secured thereto by a suitable adhesive a metal ring 30 having a coefficient of thermal expansion such that the ring and band assembly may be heated to expand the ring 30 to a diameter greater than that of the shell casing such that it may be slipped over the shell casing to its desired location. The metal ring is then cooled to shrink-fit same around the shell casing to secure the band and ring assembly to the shell. Preferably, the ring is shrunk fit into the band seat 26 to lock the rotating band against axial movement.

By employing the thermally expansive ring, the driving band 20 can be easily installed during fabrication of the shells with no or a minimum of dwell time in contrast to that required for molding or bonding the driving band to the shell casing. The driving band and ring assembly, having been previously fabricated at a remote location, can be heated to expand the metal ring so that it can be dropped over the shell casing and held in proper register with the shell casing as the ring thereafter cools. Such cooling can take place as additional operations are performed on the shell during fabrication thereof. Accordingly, assembly of the shell need not be disrupted for any appreciable length of time in order to install the driving band.

Although the invention has been shown and described with respect to preferred embodiments, it is obvious that equivalent alterations and modifications will occur to others skilled in the art upon the reading and understanding of the specification. The present invention includes all such equivalent alterations and modifications, and is limited only by the scope of the following claim.

The embodiments of the invention in which an exclusive property or privilege is claimed are defined as follows:

1. A method of forming a driving band on an artillery shell comprising the steps of:

(a) coating a substantially longitudinally inelastic fabric strip with uncured rubber, (b) partially curing the rubber coated strip to a tacky state, (c) wrapping the coated strip circumferentially to form an annular preform with adjacent turns of the strip being adhered together by the tacky rubber, and (d) molding and curing the preform directly on an artillery shell casing to form an integral band directly molded on the shell casing.

2. The method of claim 1 wherein step (a) includes dipping the fabric strip in a bath of uncured rubber to coat the strip and then partially curing the rubber coated strip to its tacky state.

3. The method of claim 1 wherein step (c) includes spiral-wrapping the strip to form a coiled preform.

4. The method of claim 1 wherein step (a) includes selecting the fabric strip material from the group comprising cloth fabric and metal fabric.

5. The method of claim 1 wherein step (a) includes using a rubber having a Shore A durometer hardness of at least about 75 when cured.

6. The method of claim 1 wherein step (a) includes using Buna-n rubber.

7. A band made according to any one of the methods of claims 1, 2–5 or 6.

8. A method of forming a driving band on an artillery shell comprising the steps of:

(a) coating a substantially longitudinally inelastic fabric strip with uncured rubber, (b) partially curing the rubber coated strip to a tacky state, (c) wrapping the coated strip circumferentially to form an annular preform with adjacent turns of the strip being adhered together by the tacky rubber, (d) molding and curing the preform to form an integrally molded band, (e) securing a thermally expansive ring to the radially inner surface of the molded band, (f) heating the ring to expand it to a diameter greater than that of an artillery shell casing, (g) slipping the thermally expanded ring over the shell casing and positioning it at a proper location, and (h) then cooling the ring to shrink-fit same around the casing thereby to securely affix the band to the casing.

* * * * *